United States Patent [19]

Kasai

[11] Patent Number: 4,488,339

[45] Date of Patent: Dec. 18, 1984

[54] BUCKLE ASSEMBLY

[75] Inventor: Kazumi Kasai, Namerikawa, Japan

[73] Assignee: Nippon Notion Kogyo Co., Ltd., Tokyo, Japan

[21] Appl. No.: 442,635

[22] Filed: Nov. 18, 1982

[30] Foreign Application Priority Data

Dec. 28, 1981 [JP] Japan ..... 56-195556[U]

[51] Int. Cl.[3] ..... A44B 17/00

[52] U.S. Cl. ..... 24/575; 24/579; 24/230.5 TP

[58] Field of Search ..... 24/575, 576, 577, 578, 24/579, 230.5 R, 163 R, 194, 230.5 TP, 241 SL, 238

[56] References Cited

U.S. PATENT DOCUMENTS

| | | | |
|---|---|---|---|
| 367,969 | 8/1887 | Gawn | 24/575 |
| 3,289,262 | 12/1966 | Allen | 24/579 |
| 3,520,033 | 7/1970 | Usuda | 24/575 |
| 3,665,562 | 5/1972 | Gower | 24/230.5 R |
| 3,836,049 | 9/1974 | Smith | 24/575 |
| 4,052,774 | 10/1977 | Noda | 24/575 |
| 4,363,159 | 12/1982 | Lischick | 24/575 |

FOREIGN PATENT DOCUMENTS 55-54330 12/1980 Japan .

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A buckle assembly comprises a socket and a plug which are made of synthetic resin and which can be assembled together. The socket includes an attachment for connection to one end of a belt, and a pair of hooks extending from the attachment, the hooks having a pair of locking bodies spaced from each other by a gap, respectively, and a pair of arms integral therewith and having a pair of first recesses opening away from each other. The plug has a base, an attachment extending therefrom for connection to an opposite end of the or another belt, and a retainer extending from the base, the retainer having a pair of spaced studs and a pair of holes disposed between the studs and the base and defining therebetween an insert and a pair of legs extending between the studs and the base. The legs have a pair of second recesses opening away from each other. The locking bodies are fittable respectively in the holes with the arms received respectively in the second recesses and the legs received respectively in the first recesses and with the insert disposed in the gap.

8 Claims, 10 Drawing Figures

BUCKLE ASSEMBLY

BACKGROUND OF THE INVENTION

Field of the Invention

The present invention relates to a buckle assembly comprising a socket and a plug which are made of synthetic resin.

SUMMARY OF THE INVENTION

It is an object of the present invention to provide a buckle assembly having a socket and a plug that can remain coupled firmly together against the danger of becoming accidentally forced apart unless manually separated.

According to the present invention, a buckle assembly comprises a socket of synthetic resin adapted to be coupled to one end of a belt and a plug of synthetic resin adapted to be coupled the other end of the or another belt, the socket and the plug being combinable together. The socket includes an attachment for connection to the belt, and a pair of hooks extending from the attachment, the hooks having a pair of locking bodies spaced from each other by a gap, respectively, and a pair of arms integral therewith and having a pair of first recesses opening away from each other. The plug has a base, an attachment extending therefrom for connection to the or a belt, and a retainer extending from the base, the retainer having a pair of spaced studs and a pair of holes disposed between the studs and the base and defining therebetween an insert, and a pair of legs extending between the studs and the base. The legs have a pair of second recesses opening away from each other. The locking bodies are fittable respectively in the holes with the arms received respectively in the second recesses and the legs received respectively in the first recesses and with the insert disposed in the gap. The socket may have a beam integral with the attachment thereof and including a central cylindrical projection receivable in a cavity defined between the studs of the plug.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
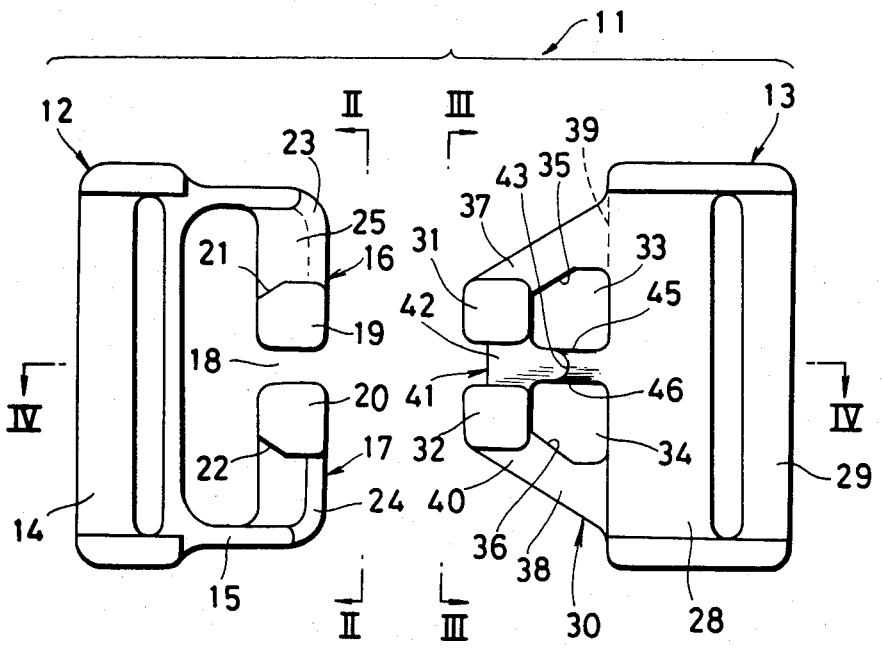
FIG. 1 is a front elevational view of a buckle assembly according to the present invention as it is separated.

As shown in FIG. 1, a buckle assembly 11 comprises a socket 12 and a plug 13 which can be assembled together, the socket 12 and the plug 13 being made of synthetic resin.

Figures 2, 3:
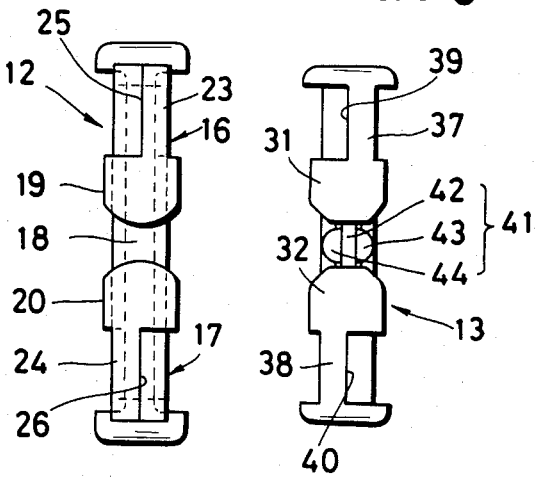
FIG. 2 is a side elevational view taken along line II—II of FIG. 1.
FIG. 3 is a side elevational view taken along line III—III of FIG. 1.

The socket 12 includes an attachment 14 to which an end of a belt (not shown) can be fixed, and a substantially C-shaped frame 15 integral with the attachment 14. The frame 15 has a pair of front hooks 16, 17 spaced from each other by a gap 18 defined therebetween. The front hooks 16, 17 have a pair of locking bodies 19, 20, respectively, on their distal ends, the locking bodies 19, 20 including a pair of slant surfaces 21, 22, respectively, facing away from the gap 18. The front hooks 16, 17 also include a pair of arms 23, 24, respectively, joined to the locking bodies 19, 20 and having a pair of symmetrical recesses 25, 26, respectively, opening away from each other, as shown in FIG. 2.

Figure 4:
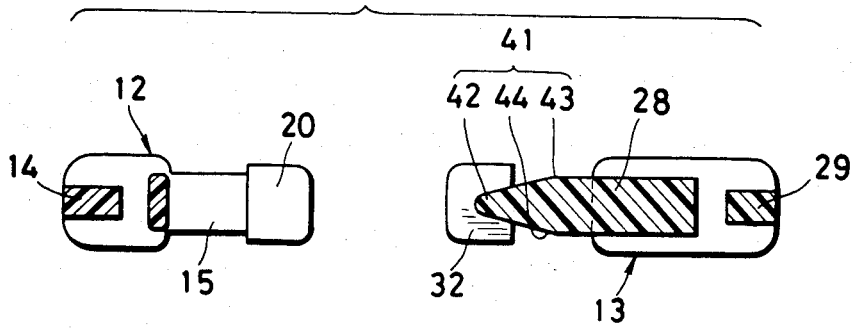
FIG. 4 is a cross-sectional view taken along line IV—IV of FIG. 1.

The plug 13 comprises a base 28 having an attachment 29 for being connected to the other end of the or another belt (not shown) and a substantially trapezoidal retainer 30 positioned remotely from the attachment 29. The retainer 30 includes a pair of spaced studs 31, 32, and a pair of holes 33, 34 defined rearward of the studs 31, 32, respectively, partly by a pair of inclined surfaces 35, 36, respectively, there being a pair of oblique legs 37, 38 extending at an angle to each other respectively between the stud 31 and the base 28 and between the stud 32 and the base 28 and having the inclined surfaces 35, 36, respectively. The studs 31, 32 and the holes 33, 34 define therebetween an elongated insert 41 composed of a front wedge-shaped portion 42 (FIGS. 4 and 5) and a pair of lands 43, 44 of semicircular cross section (FIG. 3) blending into the front wedge-shaped portion 42 and becoming progressively thicker away from the latter. The lands 43, 44 have a total thicknesss greater than the width of the gap 18 between the locking bodies 19, 20 as they are in a free state, and a width equal to that of the gap 18. The oblique legs 37, 38 have a pair of symmetrical recesses 39, 40, respectively, opening away from each other, as illustrated in FIG. 3.

Figure 5:
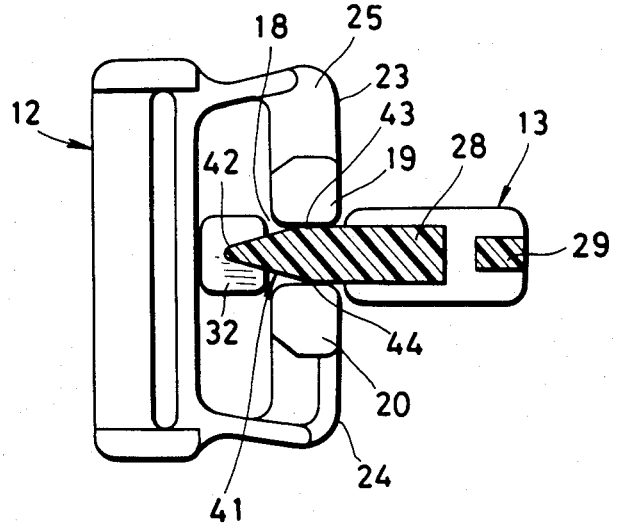
FIG. 5 is a front elevational view of the buckle assembly as it is in the process of being assembled together.
Figure 6:
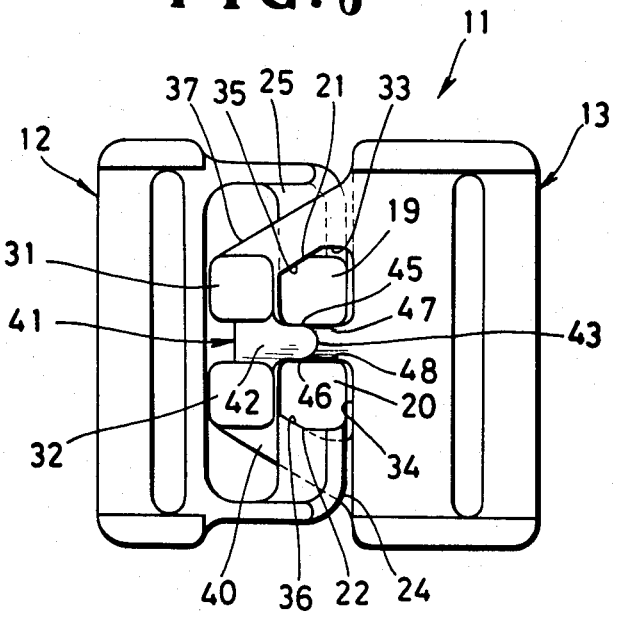
FIG. 6 is a front elevational view of the buckle assembly as put together.
Figure 10:
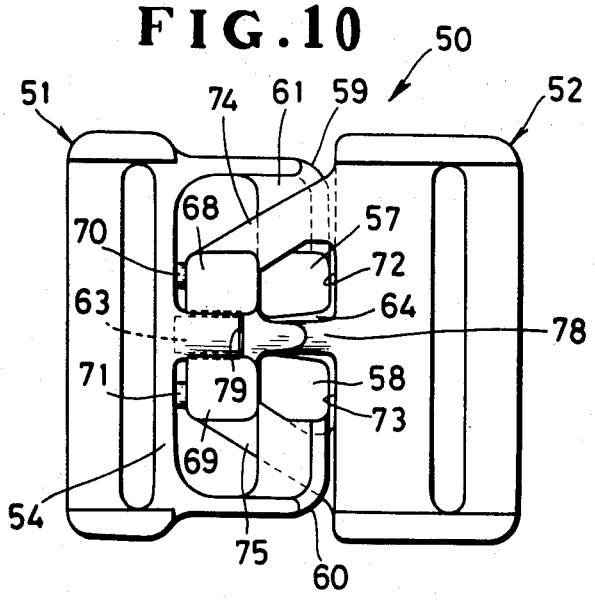
FIG. 10, appearing with FIG. 6, is a front elevational view of the buckle assembly shown in FIG. 7 as combined together.

For coupling the socket 12 and the plug 13 together, the plug 13 is held perpendicularly to the socket 12, and the insert 41 is pushed into the gap 18, as shown in FIG. 5. As the insert 41 is forced in, it progressively spreads the locking bodies 19, 20 apart until the lands 43, 44 are resiliently held against the locking bodies 19, 20 along lines of contact because of the arcuate surfaces of the locking bodies 19, 20. The plug 13 is then turned or twisted with respect to the socket 12 about the insert 41 to snap the legs 37, 38 respectively into the recesses 25, 26 and also to snap the arms 23, 24 respectively into the recesses 39, 40, as illustrated in FIG. 6. Such snapping action is quickly effected due to the resiliency of the hooks 16, 17. In addition, the arcuate surfaces of the lands 43, 44 can smoothly slide with respect to the locking bodies 19, 20, respectively, thus assisting the plug 13 in being turned over easily with a relatively small force applied. In FIG. 6, the locking bodies 19, 20 are fitted respectively in the holes 33, 34 with the slant surfaces 21, 22 resiliently held against the inclined surfaces 35, 36, respectively, and with opposite faces 47, 48 of the locking bodies 19, 20 resiliently held against side faces 45, 46, respectively, of the insert 41. Such fitting engagement and interfitting engagement between the arms 23, 24 and the legs 37, 38 securely couple the socket 12 and the plug 13 together against unwanted wobbling motion. The lands 43, 44 as inserted between the locking bodies 19, 20 are prevented from being accidentally turned in a direction to disassemble the socket 12 and the plug 13 as the lands 43, 44 are confined in rotational motion between the locking bodies 19, 20 which are backed up by the legs 37, 38. The socket 12 and the plug 13 can manually be pried apart by twisting back the plug 13 with respect to the socket 12.

FIGS. 7 through 10 show a buckle assembly according to another embodiment of the present invention.

Figure 7:
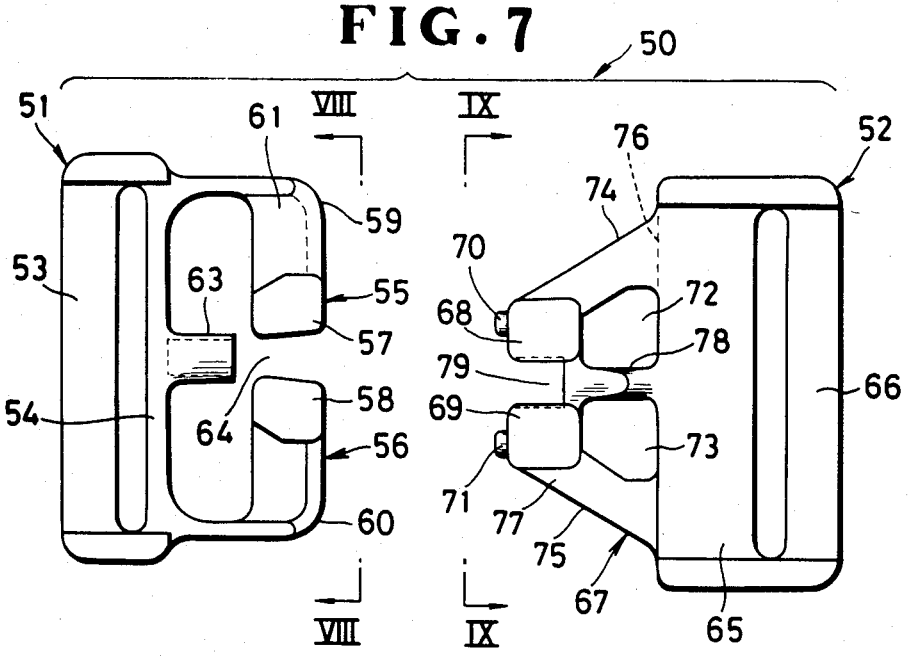
FIG. 7 is a front elevational view of a buckle assembly according to another embodiment as it is separated.
Figure 8:
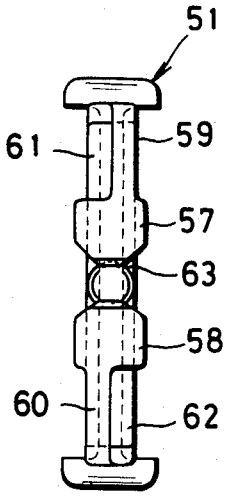
FIG. 8 is a side elevational view taken along line VIII—VIII of FIG. 7.
Figure 9:
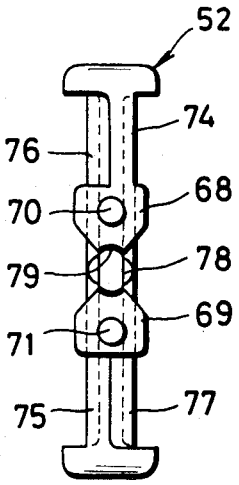
FIG. 9 is a side elevational view taken along line IX—IX of FIG. 7.

In FIG. 7, a buckle assembly 50 comprises a socket 51 and a plug 52 which can be coupled together. The socket 51 includes an attachment 53 for connection to one end of a belt (not illustrated) and a beam 54 integral therewith and having a pair of hooks 55, 56 extending therefrom. The hooks 55, 56 have a pair of locking bodies 57, 58, respectively, at their distal ends and a pair of arms 59, 60, respectively, having a pair of recesses 61, 62 (FIG. 8), respectively, opening away from each other. The beam 54 also has a central hollow cylindrical projection 63 extending away from the attachment 53 in alignment witn a gap 64 defined between the locking bodies 57, 58.

The plug 52 comprises a base 65, an attachment 66 for being coupled to the other end of the or another belt, and a substantially trapezoidal retainer 67. The retainer 67 has a pair of spaced studs 68, 69 having a pair of pins 70, 71, respectively, projecting away from the base 65. The retainer 67 also has a pair of spaced holes 72, 73 defining a pair of legs 74, 75, respectively, extending between the studs 68, 69 and the base 65. The legs 74, 75 have a pair of recesses 76, 77 (FIG. 9) opening away from each other. Between the spaced holes 72, 73, there is defined an insert 78 joined between the studs 68, 69 and the base 65. The spaced studs 68, 69 jointly define therebetween a cavity 79 complementary in shape to and receptive of the cylindrical projection 63 on the socket 51.

The buckle assembly 50 can be put together in substantially the same manner as that for assembling the buckle assembly 11 shown in FIG. 1.

More specifically, the plug 52 is directed perpendicularly to the socket 51, and brought toward the latter to cause the insert 78 to enter the gap 64 with the cylindrical projection 63 received in the cavity 79. The plug 52 and the socket 51 are continuously moved toward each other until the cylindrical projection 63 is fully inserted in the cavity 79. Then, the plug 52 is twisted about the insert 78 and the cylindrical projection 63 to bring the legs 74, 75 into interfitting engagement with the arms 59, 60, respectively and to insert the locking bodies 57, 58 into the holes 72, 73, respectively. At this time, the pins 70, 71 are held against the beam 54 one on each side of the cylindrical projection 63. The cylindrical projection 63 as fitted in the cavity 79 allows the plug 52 to be twisted more smoothly with respect to the socket 51. Furthermore, the socket 51 and the plug 52 remain more securely assembled together against accidental separation because of the cylindrical projection 63 received in the cavity 79.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A buckle assembly comprising:

(a) a socket of synthetic resin including an attachment for connection to one end of a belt, and a pair of hooks extending from said attachment, said hooks having a pair of locking bodies spaced from each other by a gap, respectively, and a pair of arms integral therewith and having a pair of first recesses opening away from each other; and (b) a plug of synthetic resin adapted to be combined with said socket and including a base, an attachment extending therefrom for connection to an opposite end of the or another belt, and a retainer extending from said base, said retainer having a pair of spaced studs and a pair of holes disposed between said studs and said base and defining therebetween an insert and a pair of legs extending between said studs and said base, said legs having a pair of second recesses opening away from each other, said locking bodies being fittable respectively in said holes with said arms received respectively in said second recesses and said legs received respectively in said first recesses and with said insert disposed in said gap.

2. A buckle assembly according to claim 1, said locking bodies of said socket having a pair of slant surfaces, and said legs of said plug having a pair of inclined surfaces engageable with said slant surfaces, respectively.

3. A buckle assembly according to claim 1, said locking bodies of said socket having a pair of opposite faces, and said insert having a pair of side faces engageable with said opposite faces, respectively.

4. A buckle assembly according to claim 1, said retainer of said socket having a substantially trapezoidal shape, said legs of said plug being inclined with respect to each other.

5. A buckle assembly according to claim 1, said insert of said plug including a wedge-shaped portion and a pair of lands extending therefrom and projecting away from each other, said lands having a width substantially equal to the width of said gap and a total thickness greater than the width of said gap.

6. A buckle assembly according to claim 5, each of said lands having a semicircular cross section.

7. A buckle assembly according to claim 1, said socket including a beam integral with said attachment of the socket and having a cylindrical projecting extending away from said attachment of the socket and held in alignment with said gap, said studs of said plug jointly defining therebetween a cavity receptive of said cylindrical projection for guiding it.

8. A buckle assembly according to claim 7, said studs having a pair of pins, respectively, engageable with said beam, one on each side of said cylindrical projection.

* * * * *